US011598100B1

(12) United States Patent
Lepior

(10) Patent No.: US 11,598,100 B1
(45) Date of Patent: Mar. 7, 2023

(54) ROOF SHEATH CONNECTING APPARATUS AND ASSOCIATED METHOD OF USE

(71) Applicant: Vicki Lepior, Fennville, MI (US)

(72) Inventor: Vicki Lepior, Fennville, MI (US)

( * ) Notice: Subject to any disclaimer, the term of this patent is extended or adjusted under 35 U.S.C. 154(b) by 0 days.

(21) Appl. No.: 17/471,333

(22) Filed: Sep. 10, 2021

(51) Int. Cl.
*E04D 15/04* (2006.01)
*E04F 13/08* (2006.01)

(52) U.S. Cl.
CPC ..... *E04D 15/04* (2013.01); *E04F 13/0887* (2013.01); *E04D 2015/042* (2013.01)

(58) Field of Classification Search
CPC . E04D 15/04; E04D 2015/042; E04F 13/0887
USPC ..... 52/289
See application file for complete search history.

(56) References Cited

U.S. PATENT DOCUMENTS

| | | | |
|---|---|---|---|
| 1,579,715 | A | 4/1926 | Boyle |
| 4,071,994 | A | 2/1978 | Ammann |
| 4,258,519 | A | 3/1981 | Hugens |
| 4,703,603 | A | 11/1987 | Hills |
| 4,864,781 | A | 9/1989 | Emblin |
| 5,079,889 | A | 1/1992 | Wright |
| 5,423,156 | A | 6/1995 | Nellessen, Jr. |
| 5,546,716 | A | 8/1996 | Broxterman et al. |
| 5,557,903 | A | 9/1996 | Haddock |
| 5,617,690 | A | 4/1997 | Gibbs |
| 5,785,478 | A | 7/1998 | Rotter |
| 5,921,045 | A | 7/1999 | Hickey et al. |
| 6,052,961 | A | 4/2000 | Gibbs |
| 6,186,698 | B1 | 2/2001 | Knapp |
| 6,237,300 | B1 | 5/2001 | Carne et al. |
| 6,904,730 | B2 | 6/2005 | Mitchell |
| 7,444,792 | B2 | 11/2008 | Matson |
| 7,637,065 | B2 | 12/2009 | Ahren |
| 8,707,647 | B2 | 4/2014 | Crego |
| 9,631,377 | B2 * | 4/2017 | Browne ..... E04F 19/063 |
| 9,951,514 | B2 | 4/2018 | Debuff |
| 10,006,204 | B1 | 6/2018 | Robinson |
| 10,202,991 | B2 | 2/2019 | Lewis |
| 10,428,517 | B1 | 10/2019 | Starks, Jr. |
| 2004/0103592 | A1 | 6/2004 | Edvardsen |

(Continued)

OTHER PUBLICATIONS

Office Action for U.S. Appl. No. 16/292,841 dated Jul. 9, 2021.

(Continued)

*Primary Examiner* — Patrick J Maestri
(74) *Attorney, Agent, or Firm* — King & Partners, PLC

(57) ABSTRACT

An apparatus for connecting roof sheathing, including: (a) a left side member, wherein the left side member includes a length, a top surface, and a bottom surface; (b) a first upright member, wherein the first upright member includes a length, an outer surface, and an inner surface, and wherein the first upright member emanates contiguously and substantially orthogonally from the left side member; (c) a second upright member, wherein the second upright member includes a length, an outer surface, and an inner surface, and wherein the second upright member emanates contiguously from and substantially parallel to the first upright member; and (d) a right side member, wherein the right side member includes a length, a top surface, and a bottom surface, and wherein the right side member emanates contiguously and substantially orthogonally from the second upright member.

11 Claims, 6 Drawing Sheets

(56) References Cited

U.S. PATENT DOCUMENTS

| | | | | |
|---|---|---|---|---|
| 2009/0056235 | A1 | 3/2009 | Morsching | |
| 2009/0229209 | A1 | 9/2009 | Crego | |
| 2009/0293383 | A1 | 12/2009 | Venter | |
| 2010/0083589 | A1 | 4/2010 | Crego | |
| 2010/0287849 | A1 | 11/2010 | Covone | |
| 2011/0197520 | A1 | 8/2011 | Preston | |
| 2012/0304578 | A1 | 12/2012 | Williams | |
| 2017/0081840 | A1* | 3/2017 | DeBuff | E04F 19/00 |
| 2019/0316356 | A1 | 10/2019 | Zhu | |

OTHER PUBLICATIONS

Office Action for U.S. Appl. No. 16/292,841 dated Mar. 26, 2021.
Office Action for U.S. Appl. No. 16/292,841 dated Sep. 30, 2020.
Office Action for U.S. Appl. No. 16/292,841 dated Jul. 24, 2020.
Office Action for U.S. Appl. No. 16/876,497 dated Jul. 2, 2021.

* cited by examiner

ROOF SHEATH CONNECTING APPARATUS AND ASSOCIATED METHOD OF USE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

The present invention relates in general to a connecting or joining apparatus and, more particularly, to an apparatus for connecting roof sheathing (e.g., oriented strand board (OSB), plywood, etcetera) which enables structurally sound, rapid, and waterproof installation of roof sheathing to one or more trusses without the use of, for example, individual H-shaped clips, which are both cumbersome and time consuming to install, and which expose the sub-floor of a building under construction to damage from water and/or other external elements. Furthermore, even when a roofing installer is conscientious and pays meticulous attention to detail, the use of conventional H-shaped clips, which are required for compliance with most building codes, leave gaps in the roof structure, thereby commonly rendering the roof sheathing non-waterproof and exposing the sub-floor to water damage.

The present invention eliminates the problems associated with the use of conventional H-shaped clips, and other connectors, by providing an apparatus that enables structurally sound, rapid, and waterproof installation of roof sheathing, thereby protecting the sub-floor of a building under construction.

2. Background Art

Clips, joiners, and connectors for use in roofing applications have been known in the art for years, and are the subject of a plurality of patents including, for example: U.S. Pat. No. 7,444,792 entitled "H Clip," U.S. Pat. No. 6,904,730 entitled "Roof Panel Clip," U.S. Pat. No. 6,237,300 entitled "Wall Stud Connectors," U.S. Pat. No. 6,186,698 entitled "Connecting Element," U.S. Pat. No. 5,921,045 entitled "Tile Roof Construction," U.S. Pat. No. 5,557,903 entitled "Mounting Clip for Paneled Roof," U.S. Pat. No. 5,546,716 entitled "Joist Bridge," U.S. Pat. No. 5,423,156 entitled "Sheathing Strap and Alignment Guide," U.S. Pat. No. 5,079,889 entitled "Roof Tile Fixing Clip," U.S. Pat. No. 4,703,603 entitled "Plywood Sheeting Spacer Clip," and U.S. Pat. No. 4,258,519 entitled "Means for Joining Panels"—all of which are hereby incorporated herein by reference in their entirety including all references cited therein.

U.S. Pat. No. 7,444,792 appears to disclose an H-shaped clip that is used to connect two pieces of building material such as plywood, roofing sheath, wafer board or other materials allegedly quickly, easily and securely. The H-shaped clip includes two tapered arms connected by a spacing bar, where each arm ends in a ski-shaped lead-in having a contoured face and a living hinge.

U.S. Pat. No. 6,904,730 appears to disclose a roof panel clip that extends ten feet in length rather than the usual prior art one to two inches, enabling the clip to span the distance between two purlins to support roof panels over these distances. The extended length of the clip enables it to provide greater strength against uplift loads than that which was possible with narrower clips and this continuous clip can be installed more quickly than a series of the usual smaller clips used to cover the same span.

U.S. Pat. No. 6,237,300 appears to disclose a tie bracket for linking adjacent end studs of two or more stud wall subframes extending at an angle to each other, which comprises a shaped element of sheet metal which includes a generally polygonal center portion defining at least three margins intersecting at respective corners, for being accommodated between the end studs. A plurality of tabs project respectively from at least two of the margins for engaging respective apertures in the end studs. Each tab is of a length in the direction of projection greater than its width and of broadly similar order to the lengths of the longer of said margins. Respective formations are provided in each of the tabs to define alternative bending lines spaced in the direction of projection.

U.S. Pat. No. 6,186,698 appears to disclose a combination of a construction member with a connecting element. The construction member includes a groove having opposite, inwardly mutually divergent, planar side wall portions. The connecting element, as viewed longitudinally, is formed as a rail section and includes at least two elastic legs cooperating as a pair having a free outer end. The legs are bendable to one another into a compressed condition. In a relaxed, uninstalled state the outer sides of said legs are mutually divergent towards the free outer end, and in an installed state the legs of the pair are received in the groove in the compressed condition such that the outer sides of the legs are mutually divergent towards the free outer end, whereby the outer sides of the legs resiliently engage the planar side wall portions of the groove of the construction member for holding the connecting element in the groove by friction.

U.S. Pat. No. 5,921,045 appears to disclose a two-part fastening mechanism employing: (1) a continuous metal strip having attachment slots whose axes are oriented parallel to the length of the strip; and (2) a single preformed metal connector piece having a longitudinally-oriented hook for gripping one end of a tile and a stem portion insertable into one of the slots in the metal fastening strip and bendable over the slot and back upon itself for retaining the connector piece attached to the continuous metal strip. When installed, the fastening mechanism holds each tile in two places: at a first end via the hook, and at an opening in the tile where the connector piece passes through.

U.S. Pat. No. 5,557,903 appears to disclose a mounting clip for installing a roofing panel onto an underlying support structure in sliding relation therewith. In one embodiment, the mounting clip generally includes a first member, having a base and first and second laterally disposed channel members, and a second member, having a platform and first and second laterally disposed leg members slidably engagable with said first and second channel members, respectively. Preferably, the clip assembly is substantially symmetrical to provide for a desired force distribution and to impart a desired degree of strength.

U.S. Pat. No. 5,546,716 appears to disclose a bridging joist that does not interfere with the installation of the way heat and air conditioning runs by longitudinally spaced, transverse plate members which extend between the joists and have a span that may be varied to accommodate a particular joist spacing. Each of the plate members presents a major surface that is disposed in an upright plane, a central opening being provided through the surface for receiving a longitudinally extending conduit. The openings in the spaced plate members are aligned so that the conduit may be readily installed and supported by the plate members. The bridging, therefore, enhances the structural rigidity of the joists and supports the conduit in the space between the joists without interfering with installation of the conduit.

U.S. Pat. No. 5,423,156 appears to disclose a strap for installation over sheathing to hold the sheathing to an underlying structural frame member through the use of interconnecting bands and saddle. The saddle is positioned on the underside of a structural member and receives the bands. Tabs are provided at both ends of the sheathing strap to receive the connecting bands and are also used to align the strap with an underlying structural member. Patterns of through holes are provided in the strap as a fastener alignment guide and are to be used for installation of fasteners after the strap is aligned with the underlying structural member.

U.S. Pat. No. 5,079,889 appears to disclose a tile clip for a pitched roof of laterally interlocked tiles for restraining a tile against movement away from, and movement down, the roof. The clip is secured to a roof batten adjacent the lower end of the tile, on which batten rest tiles in a row below the row containing the tile, being overlapped by the said tile. The clip comprises first, second and third portions; the first portion being securable to the batten, without removing the tiles resting thereon, and extending up to the end of such tiles; the second portion extending from the first portion to the upper surface of the tiles resting on the batten; and the third portion extending from the second portion down the tiles resting on the batten along the join between the said tile in the row above and a tile laterally adjacent thereto, to the lower end of said tile. The third portion terminates in a book portion which extends laterally and upwardly therefrom so as to hook over the lower end of the said tile and extend into the interlocking region of the said tile and the laterally adjacent tile.

U.S. Pat. No. 4,703,603 appears to disclose a clip to maintain a selected spacing between abutting plywood sheets which comprises an I-shaped structure having parallel upper and lower webs joined at right angles to a connecting web perpendicular thereto and a spacing structure projecting outwardly from only one side of the connecting web which maintains the appropriate spacing between adjacent sheets.

U.S. Pat. No. 4,258,519 appears to disclose a device for joining panels comprising first and second panel receiving means. An extrusion molded member forming part of said first and second panel receiving means having a flange, in use, engaging around an edge of a panel and having a first groove, one edge of which is inwardly turned to constitute a lip. An extrusion molded gripping member having a groove which receives said lip. One edge of said gripping member being arranged to abut against the inside of the first groove. A second edge of said gripping member remote from said first edge being arranged, in use, to engage the panel whereby the panel is resiliently gripped between said second edge and said flange, a second panel being retained by said second panel receiving means.

While the above-identified patents do appear to disclose clips, joiners, and connectors for use in roofing and building applications, their configurations remain non-desirous and/or problematic inasmuch as, among other things, none of the above-identified elements appear to provide an apparatus for connecting roof sheathing which enables structurally sound, rapid, and waterproof installation of roof sheathing to one or more trusses.

These and other objects of the present invention will become apparent in light of the present specification, claims, and drawings.

SUMMARY OF THE INVENTION

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

The present invention is directed to an apparatus for connecting roof sheathing, comprising, consisting essentially of, and/or consisting of: (a) a left side member, wherein the left side member comprises a length, a top surface, and a bottom surface; (b) a first upright member, wherein the first upright member comprises a length, an outer surface, and an inner surface, and wherein the first upright member emanates contiguously and substantially orthogonally from the left side member; (c) a second upright member, wherein the second upright member comprises a length, an outer surface, and an inner surface, and wherein the second upright member emanates contiguously from and substantially parallel to the first upright member; and (d) a right side member, wherein the right side member comprises a length, a top surface, and a bottom surface, and wherein the right side member emanates contiguously and substantially orthogonally from the second upright member.

In a preferred embodiment of the present invention, the left side member and the right side member are substantially parallel to one another.

In another preferred embodiment of the present invention, the top surface and the bottom surface of the left side member are planar.

In yet another preferred embodiment of the present invention, the outer surface and the inner surface of the first upright member are planar.

In a preferred embodiment of the present invention, the top surface and the bottom surface of the right side member are planar.

In one preferred embodiment of the present invention, at least a portion of the first and/or second upright members comprise an adhesive. In this embodiment, the adhesive preferably comprises butyl tape.

In another preferred embodiment of the present invention, a void is positioned between the inside surfaces of the first and second upright members.

In yet another preferred embodiment of the present invention, the left side member and the right side member extend parallel to each other in the same horizontal plane.

In another preferred aspect of the present invention, the first and second side members extend parallel to each other in different vertical planes.

The present invention is further directed to an apparatus for connecting roof sheathing, comprising, consisting essentially of, and/or consisting of: (a) a left side member, wherein the left side member comprises a length, a top surface, and a bottom surface; (b) an upright member, wherein the upright member comprises a length, a left outer surface, and a right outer surface, wherein the upright member emanates contiguously and substantially orthogonally from the left side member; and (c) a right side member, wherein the right side member comprises a length, a top surface, and a bottom surface, and wherein the right side member emanates contiguously and substantially orthogonally from the upright member.

In a preferred embodiment of the present invention, the left side member and the right side member are substantially parallel to one another.

In another preferred embodiment of the present invention, the top surface and the bottom surface of the left side member are planar.

In yet another preferred embodiment of the present invention, the left outer surface and the right outer surface of the upright member are planar.

In one preferred embodiment of the present invention, the top surface and the bottom surface of the right side member are planar.

In a preferred embodiment of the present invention, at least a portion of the left outer surface and/or the right outer surface of the upright member comprises an adhesive. In this embodiment, the adhesive comprises butyl tape.

In a preferred embodiment of the present invention, the left side member and the right side member extend parallel to each other in the same horizontal plane.

The present invention is also directed to a roof assembly, comprising, consisting essentially of, and/or consisting of: (a) a plurality of trusses associated with a load bearing wall of a building structure; (b) a roof sheath connecting apparatus secured to at least one truss, wherein the roof sheath connecting apparatus includes a left side member, a right side member, a first upright member, and a second upright member; (c) a first roof sheath secured to the left side member of the roof sheath connecting apparatus; (d) a second roof sheath secured to the right side member of the roof sheath connecting apparatus; (e) wherein the first and second upright members are positioned between the first and second roof sheaths; (f) an underlayment layer positioned on the first and second roof sheaths; and (g) a plurality of shingles secured to the first and second roof sheaths.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted.

It will be further understood that the invention is not necessarily limited to the particular embodiments illustrated herein.

Figure 1:
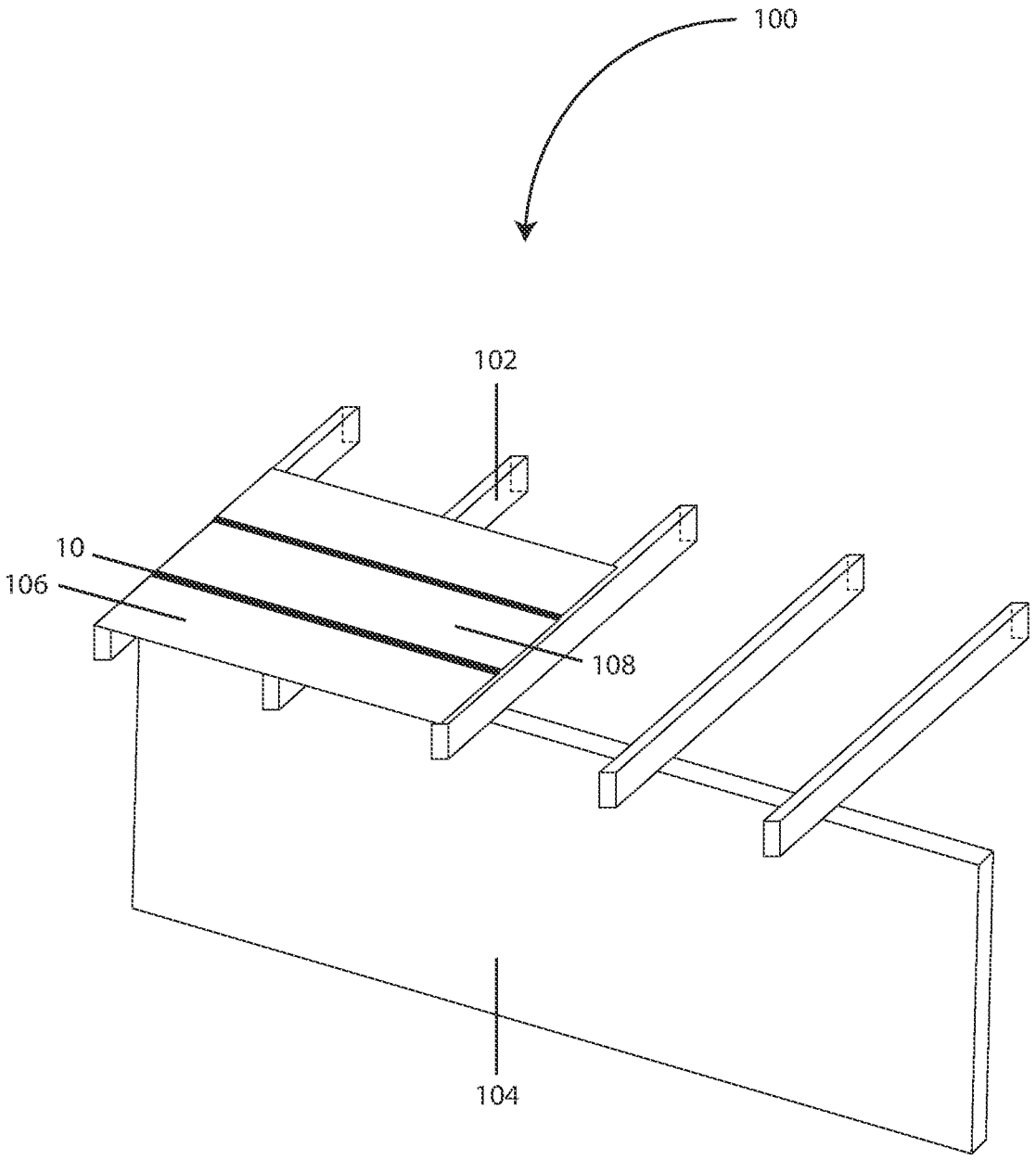
Figure 2:
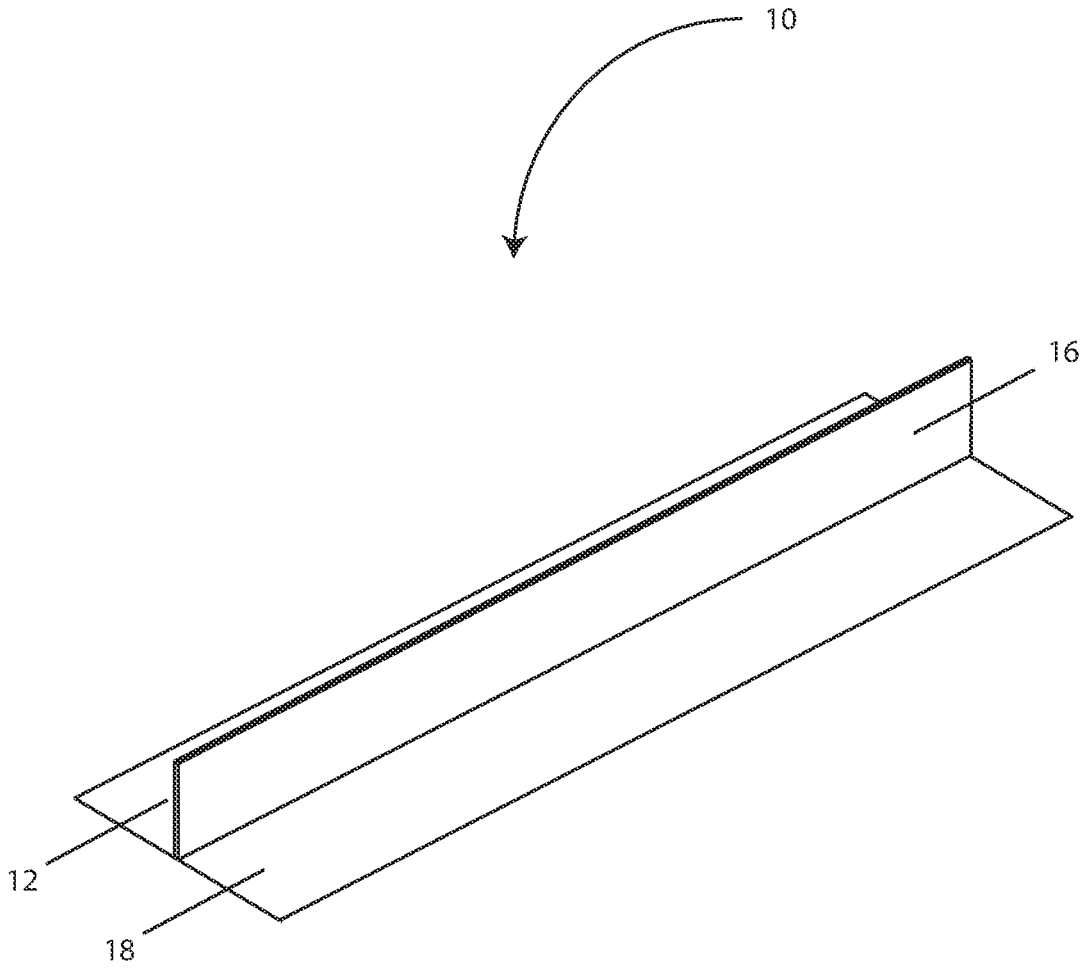
Figure 3:
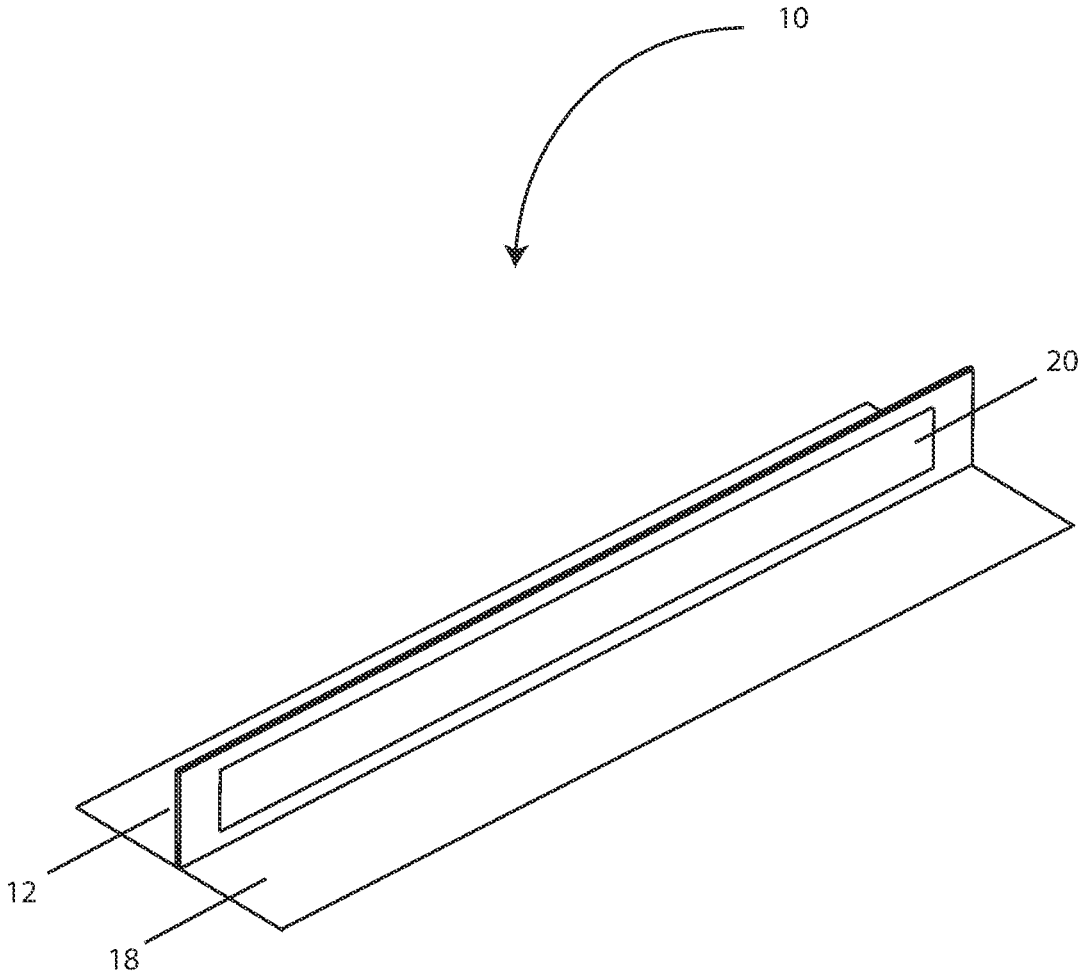
Figure 4:
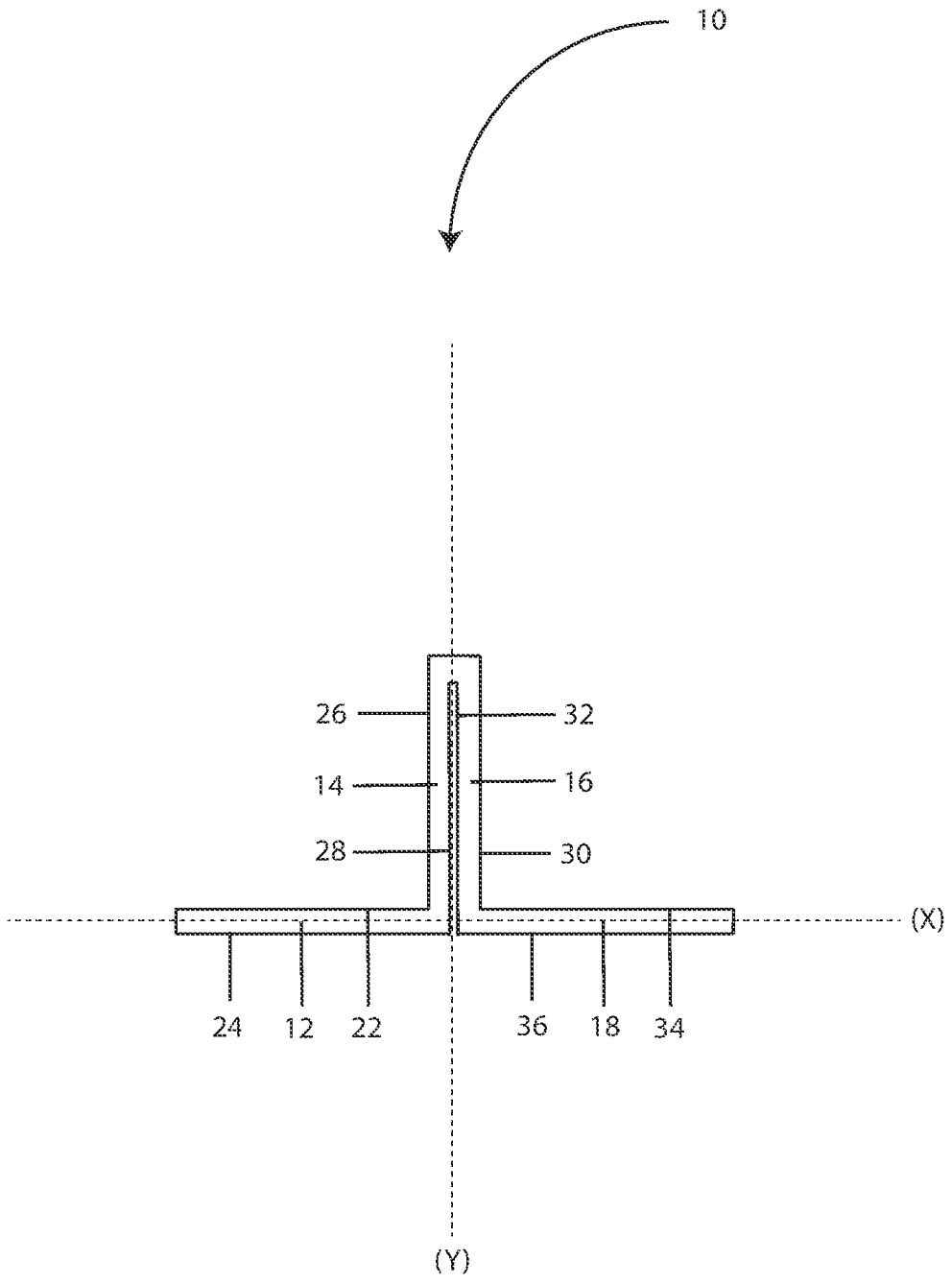
Figure 5:
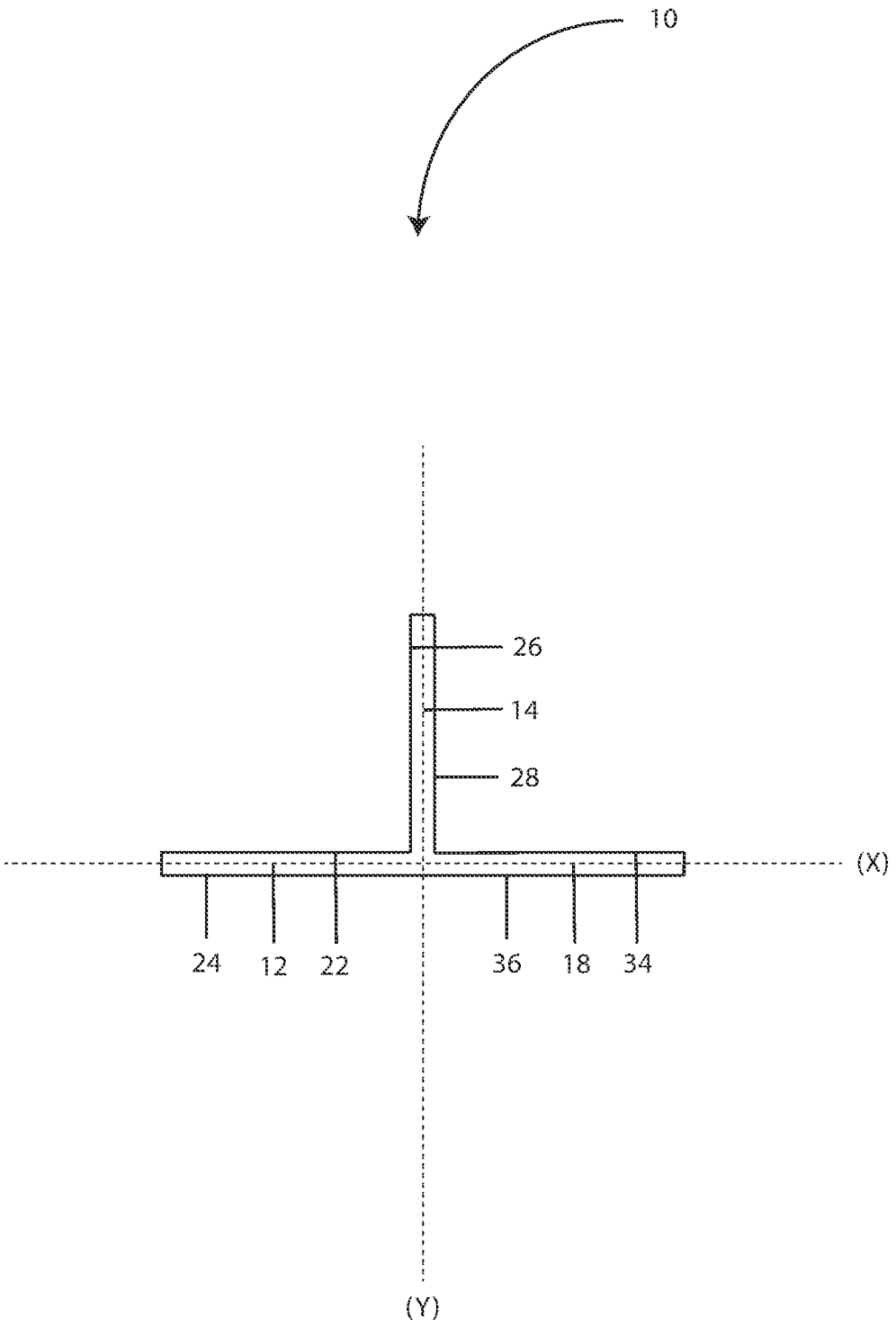
Figure 6:
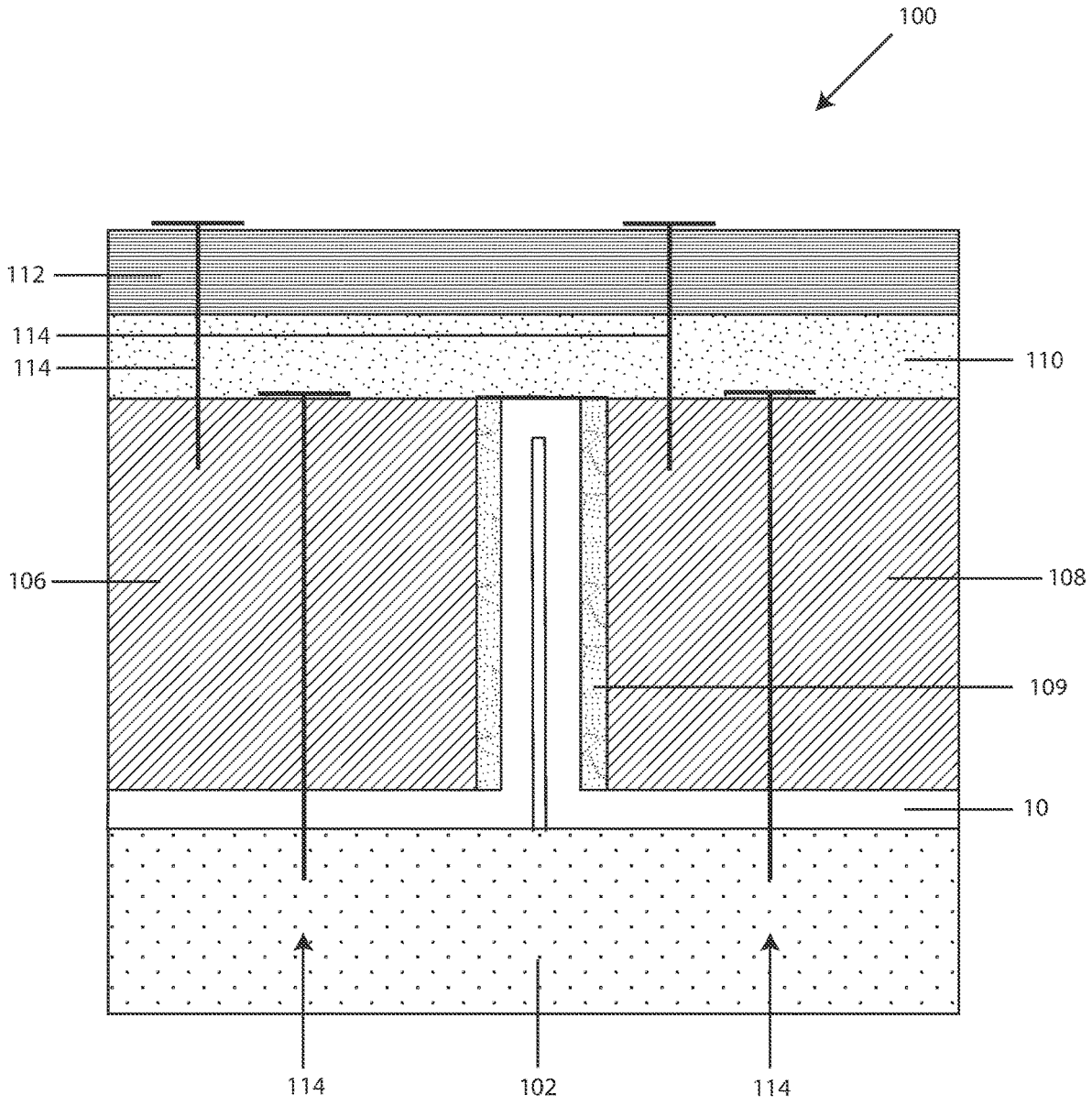

The invention will now be described with reference to the drawings wherein:

FIG. 1 is an elevated, front perspective view of a partially assembled roof assembly in accordance with the present invention;

FIG. 2 is a front perspective view of an apparatus for connecting roof sheathing constructed in accordance with the present invention;

FIG. 3 is a front perspective view of an apparatus for connecting roof sheathing constructed in accordance with the present invention showing an adhesive associated with an intermediate, upright member or section;

FIG. 4 is a cross-sectional view of the apparatus for connecting roof sheathing of FIG. 2;

FIG. 5 is a cross-sectional view of an alternative embodiment of an apparatus for connecting roof sheathing; and FIG. 6 is a cross-sectional view of the apparatus of FIG. 2 secured to roof sheaths and a truss.

DETAILED DESCRIPTION OF THE INVENTION

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of one or more embodiments of the invention, and some of the components may have been distorted from their actual scale for purposes of pictorial clarity.

Referring now to the drawings, and to FIGS. 1-4 in particular, apparatus 10 for connecting roof sheathing is shown which generally comprises left side member 12 (i.e., element, component, section, region, etcetera), first upright member 14, second upright member 16, right side member 18, and optional adhesive 20. Apparatus 10 is adapted to connect roof sheathing which results in a structurally sound, rapid, and waterproof installation of roof sheathing to one or more trusses of a building, which are typically spaced 16 or 24 inches on center. Apparatus 10 may be any one of a number of lengths, including, but not limited to, 3 inches, 6 inches, 1 foot, 2 feet, 6 feet, 8 feet, 10 feet, 12 feet, etcetera. As such, apparatus 10 provides structural support to the roof structure between the trusses, where traditional H-clips do not. In one embodiment of the present invention, apparatus 10 is longer than the adjacent and/or associated roof sheath for rapid installation.

Apparatus 10 for connecting roof sheathing may be fabricated from any one of a number of materials such as a metal, an alloy, a polymer, a natural and/or synthetic resin, a natural product such as wood, a composite, or any combination thereof. Apparatus 10 for connecting roof sheathing may be fabricated from a single, unitary piece of material, or, alternatively may be fabricated from a plurality of pieces of material.

As is best shown in FIG. 4, left side member 12 of apparatus 10 includes a length, top surface 22, and bottom surface 24.

First upright member 14 of apparatus 10 includes a length, outer surface 26, and inner surface 28, and preferably emanates contiguously and substantially orthogonally (i.e., 0.001-10% angular deviation from a right angle) from left side member 12.

Second upright member 16 of apparatus 10 includes a length, outer surface 30, and inner surface 32, and preferably emanates contiguously from and substantially parallel (i.e., 0.001-10% angular deviation from parallel) to first upright member 14.

Right side member 18 of apparatus 10 includes a length, top surface 34, and bottom surface 36, and preferably emanates contiguously and substantially orthogonally (i.e., 0.001-10% angular deviation from a right angle) from second upright member 16.

Referring now to FIG. 5, in one embodiment, apparatus 10 may comprise: left side member 12, wherein the left side member comprises a length, top surface 22, and a bottom surface 24; a single upright member 14, wherein the upright member comprises a length, left outer surface 26, and right outer surface 28, wherein the upright member emanates contiguously and substantially orthogonally (i.e., 0.001-10% angular deviation from a right angle) from left side member 12; and right side member 18, wherein the right side member comprises a length, top surface 34, and bottom surface 36, and wherein the right side member emanates contiguously and substantially orthogonally (i.e., 0.001-10% angular deviation from a right angle) from upright member 14.

Referring now to FIG. 3, and in one preferred embodiment of the present invention, at least a portion of the first and/or second upright members comprise an adhesive that enhances the waterproof characteristics of apparatus 10 when connecting roof sheathing. In one embodiment, the adhesive comprises butyl tape. It will be understood that one or more of the surfaces of the upper, intermediate, lower, and optional return members may include an adhesive on at least a portion of their respective surfaces.

In accordance with the present invention, other adhesives and/or overcoat/gripping layers are likewise contemplated for use and are preferably fabricated from a thermoplastic elastomer, including, but not limited to, a styrenic block copolymer, a thermoplastic olefin, an elastomeric alloy, a thermoplastic polyurethane, a thermoplastic copolyester, a thermoplastic polyamide and/or one or more elastomeric materials, including, but not limited to, natural polyisoprenes, synthetic polyisoprenes, polybutadienes, chloroprene rubbers, butyl rubbers, halogenated butyl rubbers, styrene-butadiene rubbers, nitrile rubbers, hydrogenated nitrile rubbers, ethylene propylene rubbers, ethylene propylene diene rubbers, epichlorohydrin rubbers, polyacrylic rubbers, silicone rubbers, fluorosilicone rubbers, fluoroelastomers, perfluoroelastomers, polyether block amides, chlorosulfonated, ethylene-vinyl acetates, resilins, elastins, a polysulfide rubbers, elastolefins, and combinations thereof. It will be understood that any portion of apparatus 10 may be fabricated from and/or overcoated with one or more of the foregoing materials.

It will be understood if applied as an overcoat layer, the material may be associated with one or more parts and/or components of apparatus 10 via, for example, etch coating, dip coating, spin coating, brush coating and/or spray coating—including, but not limited to, cold spraying, thermal spraying, high velocity spraying (e.g., supersonic), low velocity spraying (e.g., subsonic), triboelectric discharge kinetic spraying and other similar processes.

Referring collectively now to FIGS. 1 and 6, the present invention is further directed to roof assembly 100, comprising: (a) a plurality of trusses 102 associated with load bearing wall 104 of a building structure; (b) roof sheath connecting apparatus 10 secured to at least one truss 102, wherein the roof sheath connecting apparatus includes a left side member, a right side member, a first upright member, and a second upright member (with optional adhesive 109 associated with the first and second upright members); first roof sheath 106 secured to the left side member of roof sheath connecting apparatus 10; second roof sheath 108 secured to the right side member of the roof sheath connecting apparatus 10; underlayment layer 110 positioned on the first and second roof sheaths; and a plurality of shingles 112 secured to the first and second roof sheaths. Preferably, the above-identified components are secured using conventional threaded and/or unthreaded fasteners 114.

In operation, the present invention is directed to a method for connecting roof sheathing, comprising the steps of: (1) securing (preferably via threaded and/or non-threaded fasteners) one end of first roof sheath 106 to truss 102 of a building structure; (2) providing apparatus 10 of the present invention; (3) securing roof connecting apparatus 10 to the first roof sheath and truss 102 of the building structure; (4) associating second roof sheath 108 to both truss 102 of the building structure and roof sheathing connecting apparatus 10. After the roof sheathing and the apparatus are associated with the building structure, ice and water shielding and/or underlayment 110 may be applied to at least a portion of the roof sheathing. Next, t-drip elements may be associated with at least a portion of the ice and water shielding and/or the roof sheathing. Finally, shingles 112 may be applied to the roof sheathing and/or any layer, apparatus, and/or element associated therewith.

The foregoing description merely explains and illustrates the invention and the invention is not limited thereto except insofar as the appended claims are so limited, as those skilled in the art who have the disclosure before them will be able to make modifications without departing from the scope of the invention.

While certain embodiments have been illustrated and described, it should be understood that changes and modifications can be made therein in accordance with ordinary skill in the art without departing from the technology in its broader aspects as defined in the following claims.

The embodiments, illustratively described herein may suitably be practiced in the absence of any element or elements, limitation or limitations, not specifically disclosed herein. Thus, for example, the terms "comprising," "including," "containing," etcetera shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The present disclosure is not to be limited in terms of the particular embodiments described in this application. Many modifications and variations can be made without departing from its spirit and scope, as will be apparent to those skilled in the art. Functionally equivalent methods and compositions within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can of course vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etcetera. As a non-limiting example, each range discussed herein can be readily broken down into a lower third, middle third and upper third, etcetera. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims.

What is claimed and desired to be secured by Letters Patent of the United States is:

1. An apparatus for connecting roof sheathing, comprising:

a left side member, wherein the left side member comprises a length, a top surface, and a bottom surface;

a first upright member, wherein the first upright member comprises a length, an outer surface, and an inner surface, and wherein the first upright member emanates contiguously and substantially orthogonally from the left side member;

a second upright member, wherein the second upright member comprises a length, an outer surface, and an inner surface, and wherein the second upright member emanates contiguously from and substantially parallel to the first upright member; and a right side member, wherein the right side member comprises a length, a top surface, and a bottom surface, and wherein the right side member emanates contiguously and substantially orthogonally from the second upright member, and wherein at least a portion of at least one of the first and second upright members comprise an adhesive.

2. The apparatus according to claim 1, wherein the left side member and the right side member are substantially parallel to one another.

3. The apparatus according to claim 1, wherein the top surface and the bottom surface of the left side member are planar.

4. The apparatus according to claim 1, wherein the outer surface and the inner surface of the first upright member are planar.

5. The apparatus according to claim 1, wherein the top surface and the bottom surface of the right side member are planar.

6. The apparatus according to claim 1, wherein the adhesive comprises butyl tape.

7. The apparatus according to claim 1, wherein a void is positioned between the inside surfaces of the first and second upright members.

8. The apparatus according to claim 1, wherein the left side member and the right side member extend parallel to each other in the same horizontal plane.

9. The apparatus according to claim 1, wherein the first and second side members extend parallel to each other in different vertical planes.

10. A roof assembly, comprising:

a plurality of trusses associated with a load bearing wall of a building structure;

a roof sheath connecting apparatus secured to at least one truss, wherein the roof sheath connecting apparatus includes a left side member, a right side member, a first upright member, and a second upright member;

a first roof sheath secured to the left side member of the roof sheath connecting apparatus;

a second roof sheath secured to the right side member of the roof sheath connecting apparatus;

wherein the first and second upright members are positioned between the first and second roof sheaths;

an underlayment layer positioned on the first and second roof sheaths; and a plurality of shingles secured to the first and second roof sheaths.

11. The roof assembly according to claim 10, wherein the outer surfaces of the first and second upright members include an adhesive.

* * * * *